United States Patent [19]

Maloy

[11] 4,393,972

[45] Jul. 19, 1983

[54] COIN CHUTE ASSEMBLY

[75] Inventor: Rex M. Maloy, Broken Arrow, Okla.

[73] Assignee: Orin W. Coburn, Muskogee, Okla.

[21] Appl. No.: 166,532

[22] Filed: Jul. 7, 1980

[51] Int. Cl.[3] ..... G07D 5/02; G07D 5/08; G07F 1/04

[52] U.S. Cl. ..... 194/99; 194/1 C; 194/1 K; 194/100 A

[58] Field of Search ..... 194/1 C, 1 D, 1 K, 99, 194/100 R, 100 A, 101, 102; 221/68, 299; 193/29, 31 R, DIG. 1; 73/163

[56] References Cited

U.S. PATENT DOCUMENTS

| | | | |
|---|---|---|---|
| 2,283,396 | 5/1942 | Towne | 194/1 D |
| 2,531,236 | 11/1950 | Snell et al. | 194/100 R X |
| 3,739,895 | 6/1973 | Fougere et al. | 194/100 A |
| 3,916,922 | 11/1975 | Prümm | 194/1 C X |
| 3,952,851 | 4/1976 | Fougere et al. | 194/100 A |
| 4,082,099 | 4/1978 | Iwersen | 194/102 X |
| 4,286,703 | 9/1981 | Schuller et al. | 194/100 A |

*Primary Examiner*—F. J. Bartuska

*Attorney, Agent, or Firm*—Dunlap & Codding

[57] ABSTRACT

An improved coin chute assembly wherein the housing contains a coin receiving opening, a first coin exit opening, a second coin exit opening, and a coin passageway disposed therein and interconnecting the coin receiving opening with the first and second coin exit openings. The coin passageway is characterized as having an upper coin path, a coin receiving section and a coin reject section, the upper coin path being oriented to permit a coin to fall in a substantially downward direction through the chute assembly and thus through the coin receiving section towards the first coin exit opening or through the coin reject section towards the second coin exit opening. A gate assembly is movably disposed in a portion of the coin path for blocking movement of a coin through the coin receiving section of the coin path in one position and directing the coin into the coin reject section; or for permitting movement of the coin into and through the coin receiving section while blocking movement of the coin through the coin reject section.

11 Claims, 9 Drawing Figures

COIN CHUTE ASSEMBLY

CROSS-REFERENCE TO RELATED APPLICATIONS

The subject matter of the present application is related to the subject matter of the application entitled "IMPROVED COIN CHUTE ASSEMBLY", Ser. No. 166,357, inventors Rex M. Maloy and John C. Moore, filed on July 7, 1980; and U.S. Patent Application Ser. No. D-37,813 entitled "COIN CHUTE", inventors C. David Coburn and Rex M. Maloy, filed May 10, 1979, each of which has been assigned to the assignee of the present invention.

BACKGROUND OF THE INVENTION

1. Field of the Invention

This invention relates generally to an improved coin chute and, more particularly, but not by way of limitation, to a coin chute having a coin path, coin receiving section, a coin reject section, and a gate assembly operatively positioned therein for directing the coin selectively from the coin path through either the coin receiving section or the coin reject section.

2. Description of the Prior Art

In the past, various devices have been constructed for identifying monetary inputs deposited in a coin handling apparatus. Most of the devices in the prior art have been constructed to include a large number of parts, assemblies, and cooperating mechanical and electrical interconnections therebetween thereby substantially increasing the required maintenance and the possibility of the malfunction of the coin handling apparatus.

An object of the invention is to provide a coin chute which is more reliable and substantially maintenance free in the operation thereof.

Another object of the invention is to provide an improved coin chute in which the possibilities of a malfunction are substantially reduced.

Another object of the invention is to provide an improved coin chute assembly which is economical in structure and operation and which does not suffer from the disadvantages of prior art devices.

These and other objects, advantages and features of the invention will be evident to those skilled in the art from a reading of the following detailed description when read in conjunction with the accompanying drawings which illustrate a preferred embodiment of the invention.

DESCRIPTION OF THE PREFERRED EMBODIMENT

Figure 1:
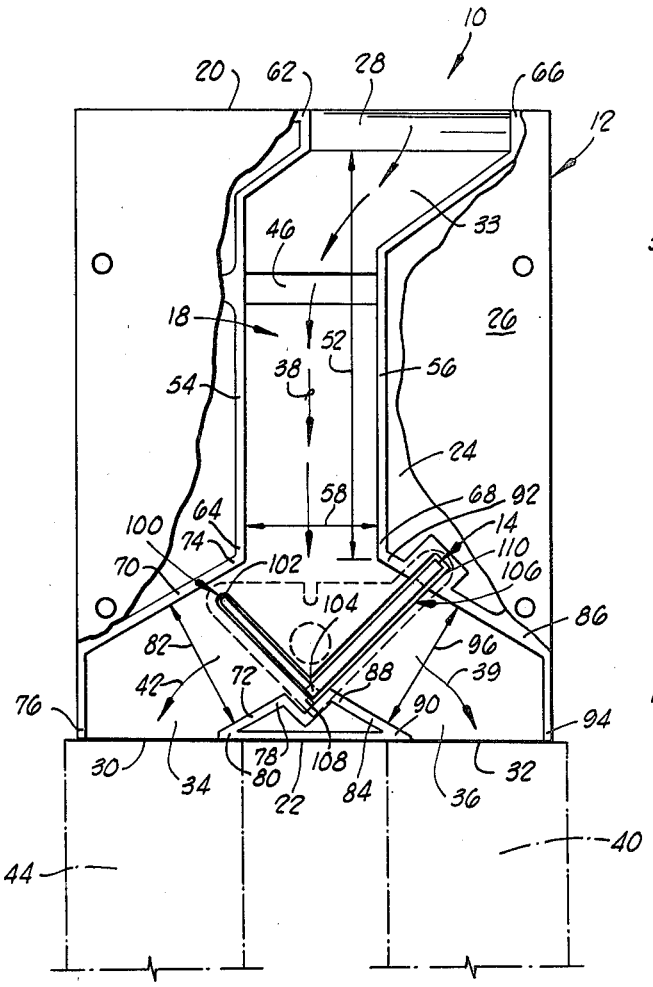
FIG. 1 is a partially cutaway front elevational view of the coin chute of the present invention depicting the coin passageway disposed therein and the positioning of the gate assembly with respect to the coin passageway.

Referring to the drawings in general, and to FIGS. 1 through 4 in particular, shown therein and designated by the general reference numeral 10 is a coin chute assembly constructed in accordance with the present invention. The coin chute assembly 10 comprises a housing 12, a gate assembly 14, and a solenoid 16 (shown in phantom in FIG. 2) operatively connected to the gate assembly 14 for moving the gate assembly in a direction about perpendicular to a coin passageway 18. The housing 12 is provided with a coin receiving end 20, an opposed second end 22, a back plate 24, and a front plate 26, the back and front plates 24 and 26 cooperating to define the coin passageway 18 in the housing 12. The coin receiving end 20 of the housing 12 is provided with a coin receiving opening 28 and the opposed end 22 of the housing 12 is provided with a first coin exit opening 30 and a second coin exit 32. The coin passageway 18 disposed within the housing 12 interconnects the coin receiving opening 28 with the first and second coin exit openings 30 and 32, respectively. The coin passageway 18 is characterized as having an upper coin path 33, a coin receiving section 34, and a coin reject section 36. A coin (not shown) entering the coin passageway 18 of the housing 12 via the coin receiving opening 28 travels through the coin path 33 along the line 38 and, then travels through the coin reject section 36 along the line 39 to a reject deposit receptacle 40 (indicated by phantom line in FIGS. 1 and 2), or through the coin receiving section 34 along the line 42 to a coin box 44 (also shown in phantom in FIG. 1).

An opening 46 is formed through the back plate 24 and an opening 48 is formed through the front plate 26 of the housing 12. An illuminating source, such as a lamp 50 (shown in phantom in FIG. 2) is mounted on the front plate 26 such that illumination from the lamp 50 is directed through the opening 48 in the front plate 26 in the direction of the opening 46 in the back plate 24. An optical sensing element 49 (shown in phantom in FIG. 2) is disposed within the opening 46 in the back plate 24 so that the optical sensing element 49 is operably aligned with the lamp 50. The openings 46 and 48 of the front and back plates 24 and 26 extend generally transversly to and intersect the upper coin path 33 substantially as shown. Further, the upper coin path 33 is disposed between the lamp 50 and the optical sensing element 49 such that an object, such as a coin, passing through the upper coin path 33 will pass between the lamp 50 and the optical sensing element 49 and block a portion of the illumination received by the optical sensing element 49 from the lamp 50 when the object is interposed therebetween. The optical sensing element 49 provides an output signal which is indicative of the amount of illumination received by the optical sensing element 49 from the lamp 50 when the object is interposed therebetween, the output signal being indicative of the diameter of the coin. Desirably, the lamp 50 provides a substantially uniform illumination across a width 58 of a portion of the upper coin path 33 and the optical sensing element 49 is of sufficient size to extend the width 58 of the upper coin path 33. Further, the lamp 50 and the optical sensing element 49 are positioned so as to transverse the upper coin path 33 of the coin passageway 18.

A magnet 51, capable of providing output signals, is mounted on the back plate 24 a distance from the optical sensing element 49 so as not to interfere with the operation of the lamp 50 or the optical sensing element 49. The magnet 51 is disposed on the back plate 24 so as to provide a magnetic field across a portion of the upper coin path 33 of the coin passageway 18. The magnet 51 can be any suitable magnet capable of providing output signals across a portion of the upper coin path 33. Typical of a magnet which can be employed is the magnetic sensor assembly disclosed in copending U.S. Patent Application Ser. No. 939,446 entitled Magnetic Sensor Assembly, filed Sept. 5, 1978 by Jiri J. Hovorka, now U.S. Pat. No. 4,258,279, issued Mar. 24, 1981 and assigned to the assignee of the subject application. The above mentioned U.S. Patent Application Ser. No. 939,446 is hereby expressly incorporated by reference into the subject disclosure.

A steel plate 53 is mounted on the front plate 26 so that a portion of the upper coin path 33 is interposed between the magnet 51 and the steel plate 53. The steel plate 53 is positioned so as to be substantially oppositely disposed the magnet 51. The steel plate 53 serves to deform the magnetic field created by the magnet 51 and thus make the magnetic field more dense in a portion of the upper coin path 33. As a metallic object, such as a coin, passes through the magnetic field in the upper coin path 33 an output signal is provided indicative of the magnetic characteristics of the coin.

The signal from the optical sensing element 49 and the magnet 51 determine whether a coin is a proper coin. If the coin is determined to be a proper coin by the combined signals from the optical sensing element 49 and the magnet 51, the solenoid 16 is activated and the gate assembly 14 positioned to enable the coin to travel through the coin receiving section 34.

As shown in FIG. 1, the coin path 33 is formed through a central portion of the housing 12 and extends from the coin receiving opening 28 of the coin receiving end 20 to a distance 52 near the opposed second end 22 of the housing 12. The coin path 33 is formed of a pair of walls 54 and 56 disposed in a generally parallel relationship with each other. The walls 54 and 56 are spaced apart a predetermined distance so as to provide the upper coin path 33 with the width 58. Further, the walls 54 and 56 provide the upper coin path 33 with a depth 60 which is less than the depth 61 of the back plate 24 of the housing 12 through which the coin path 33 is formed. The spacing or distance 58 between the walls 54 and 56 and the depth 60 of the walls 52 and 54 (only the depth 60 of the wall 56 being shown in phantom in FIG. 2) form two of the dimensions of the coin path 33. The wall 54 of the coin path is provided with an upper end 62 and an opposed lower end 64; and the wall 56 is likewise provided with an upper end 66 and an opposed lower end 68.

The coin receiving section 34 is formed by a pair of walls 70 and 72. The walls 70 and 72 are disposed in a generally parallel relationship and extend from the first coin exit opening 30 in the opposed end 22 of the housing 12 in an upwardly direction towards the walls 54 and 56 of the coin path 33. The wall 70 of the coin receiving section 34 is provided with an upper end 74 and an opposed lower end 76; and the wall 72 of the coin receiving section 34 is likewise provided with an upper end 78 and an opposed lower end 80. The upper end 74 of the wall 70 of the coin receiving section 34 abuts the lower end 64 of the wall 54 of the coin path 33. The upper end 78 of the wall 72 of the coin receiving section 34 terminates below the lower ends 64 and 68 of the walls 54 and 56, respectively, of the coin path 33 at a position substantially intermediate the walls 54 and 56 of the coin path 33. The point of termination of the upper end 78 of the wall 72 of the coin receiving section 34 provides the coin receiving section 34 with a width 82 which is substantially equal to the width 58 of the upper coin path 33.

The coin reject section 36 is formed by a pair of walls 84 and 86. The walls 84 and 86 are disposed in a generally parallel relationship and extend from the second coin exit opening 32 in the opposed end 22 of the housing 12 in an upwardly direction towards the coin path 33. The wall 84 of the coin rejection section 36 is provided with an upper end 88 and an opposed lower end 90; and the wall 86 is likewise provided with an upper end 92 and an opposed lower end 94. The upper end 92 of the wall 86 of the coin reject section 36 abuts the lower end 68 of the wall 56 of the coin path 33. The upper end 88 of the wall 84 of the coin reject section 36 is positioned so as to be in uniting alignment with the upper end 78 of the wall 72 of the coin receiving section 34 so as to provide the coin reject section 36 with a width 96 which is substantially the same as the width 82 of the coin receiving section 34. Thus, the coin path 33, the coin receiving section 34 and the coin reject section 36 cooperate to form the coin passageway 18 which has a substantially inverted Y-shaped configuration. It should be noted that, in a preferred form and as shown in the drawings, the coin passageway 18 does not extend through the housing 12 in a straight line. Further, the distances between the walls 54 and 56 of the coin path 33, generally near the turns or bends in the coin path 33, the walls 70 and 72 of the coin receiving section 34, generally near the turns or bends in the coin receiving section 34, and the walls 84 and 86 of the coin reject section 36, generally near the turns or bends in the coin reject section 36, are slightly larger with respect to the distances 58, 82 and 96 of the coin path 33, the coin receiving section 34 and the coin reject section 36, respectively, when same are in a generally straight extending position within the housing 12. This feature accommodates the traveling of the coin elements through the coin passageway 18 during the operation of the apparatus of the present invention.

The back plate 24 of the housing 12 is further provided with an elongated opening 100 extending therethrough, the elongated opening 100 being positioned so as to extend generally transversely to and intersect the coin receiving section 34 of the coin passageway 18. The elongated opening 100 is provided with a first end 102 and an opposed second end 104. The first end 102 of the elongated opening 100 terminates at a position within the coin receiving section 34 near the wall 70 of the coin receiving section 34. The opposed second end 104 of the opening 100 extends within the back plate 24 of the housing 12 a distance beyond the wall 72 of the coin receiving section 34 in a direction away from the coin receiving section 34.

A second elongated opening 106 is disposed within the back plate 24 of the housing 12 so that the second elongated opening 106 extends generally transversely to and intersects the coin reject section 36. The second elongated opening 106 is provided with a first end 108 and an opposed second end 110. The length of the elongated opening 106 is greater than the width 96 of the coin reject section 36. Thus, the first end 108 of the second elongated opening 106 extends a distance within the back plate 24 of the housing 12 beyond the wall 84 of the coin reject section 36 in a direction away from the coin reject section 36; and, the second end 110 of the elongated opening 106 extends outwardly away from the wall 86 of the coin reject section 36 and thus away from the coin reject section 36. The second end 104 of the first elongated opening 100 intersects the second elongated opening 110 near its first end 108 to form a substantially L-shaped opening as shown in FIG. 1. The cooperation of the first elongated opening 100 and the second elongated opening 106, and their respective positioning within the coin receiving section 34 and the coin reject section 36, respectively, of the coin passageway 18, cooperate in receiving the gate assembly 14 so that a portion of the gate assembly 14 is movably disposed in the coin passageway 18. Thus, in one position the gate assembly 14 blocks movement of the coin through the coin receiving section 34 and directs the coin into the coin reject section 36; and in a second position the gate assembly 14 permits movement of the coin into and through the coin receiving section 34 while blocking movement of the coin through the coin reject section 36.

To facilitate in the positioning of a coin into the coin receiving opening 28 of the housing 12, the front plate 26 of the housing 12 is provided with an enlarged tapered recessed portion 112 in the coin receiving end 20 around the coin receiving opening 28. Similarly, the back plate 24 of the housing 12 is provided with a tapered recessed portion 114 in its upper portion around the coin receiving opening 28, the tapered recesses 112 and 114 of the back and front plates 24 and 26, respectively cooperating and communicating with the coin receiving opening 28 to enlarge the coin receiving opening 28 to facilitate in the insetion of a coin therein.

Figure 2:
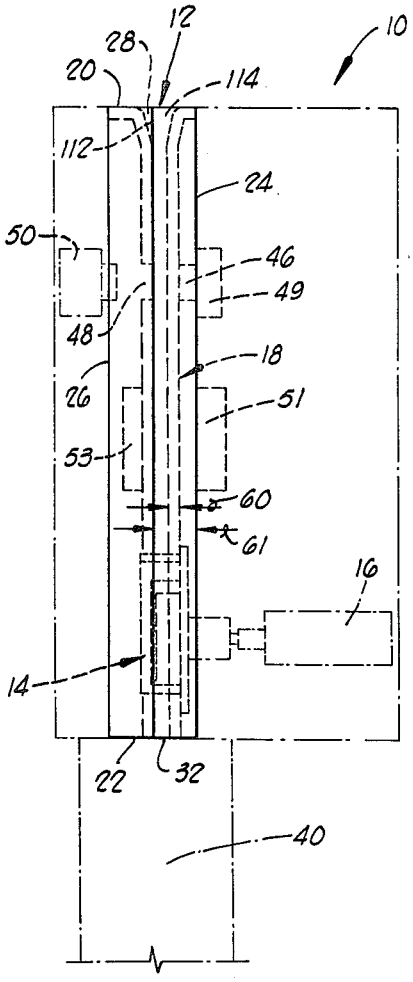
FIG. 2 is a side elevational view of the coin chute of the present invention depicting the coin passageway, gate assembly, means for operating the gate assembly, and a coin sensing element in phantom.
Figure 3:
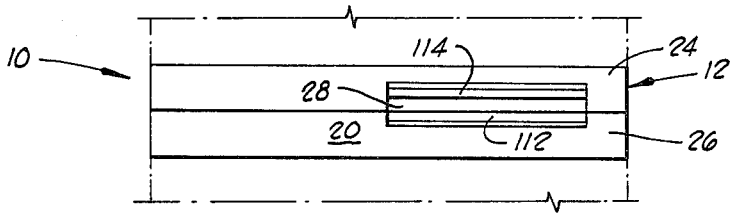
FIG. 3 is a top plan view of the coin chute of the invention illustrating the coin receiving opening of the coin chute.
Figure 4:
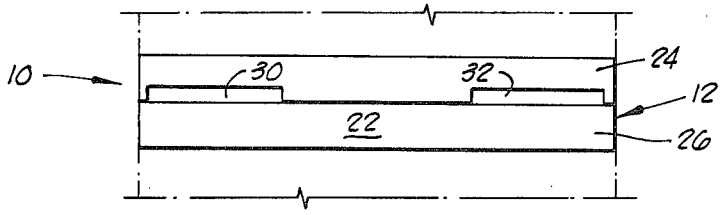
FIG. 4 is a bottom plan view of the coin chute assembly of the present invention depicting the first and second coin exit openings of the chute assembly.
Figure 5:
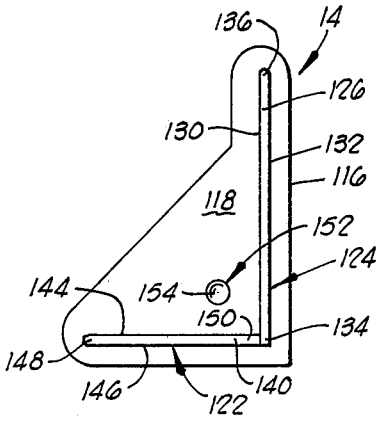
FIG. 5 is an enlarged front elevational view of the gate assembly employed in the coin chute assembly of the present invention.
Figure 6:
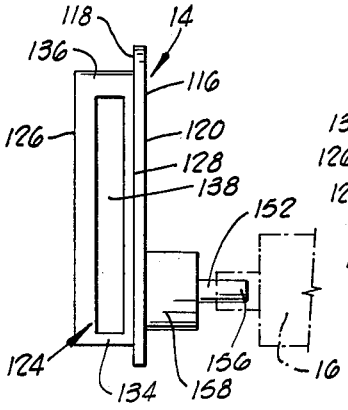
FIG. 6 is a side elevational view of the gate assembly of FIG. 5 depicting one gate of the gate assembly and showing, in phantom, means for moving the gate assembly in a direction about perpendicular to the coin passageway of the coin chute.
Figure 7:
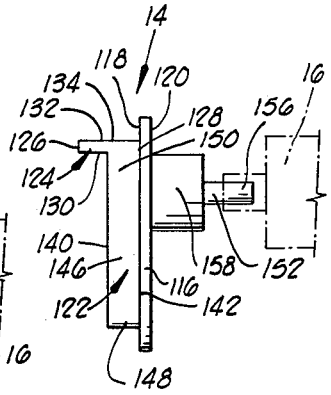
FIG. 7 is a side elevational view of the gate assembly of FIG. 5 depicting the second gate of the gate assembly and showing, in phantom, the means for moving the gate assembly in a direction about perpendicular to the coin passageway of the coin chute.
Figure 8:
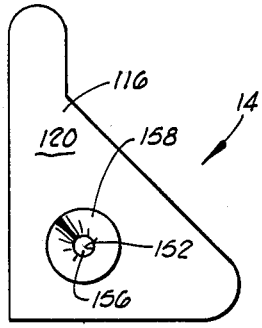
FIG. 8 is a back elevational view of the gate assembly of FIG. 5 illustrating the opposite side of the gate assembly.
Figure 9:
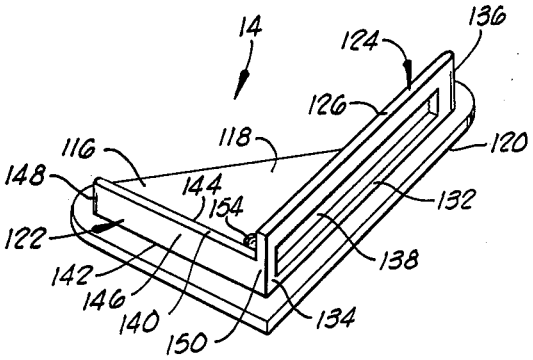
FIG. 9 is a perspective view of the gate assembly of FIG. 5.

Referring now to FIGS. 5 through 9, in combination with FIGS. 1 and 2, the gate assembly 14 of the coin chute assembly 10 comprises a body member 116 having a first side 118 and opposed second side 120, a first gate 122 and a second gate 124. The first gate 122 is disposed on the first side 118 of the body member 116 so that the first gate 122 extends upwardly from the first side 118 of the body member 116. The first gate 122 is slidably positionable within the first elongated opening 100 in the back plate 24 of the housing 12. The second gate 124 is likewise disposed on the first side 118 of the body member 116 and extends upwardly from the first side 118 of the body member 116. The second gate 124 is slidably positionable within the second elongated opening 106 in the back plate 24 of the housing 12.

Referring more particularly to FIGS. 5 through 9, the second gate 124 is provided with an upper side 126, an opposed lower side 128, a first side 130, an opposed second side 132, a first end 134 and an opposed second end 136. An elongated opening 138 is disposed within the second gate 124 between the first end 134 and the second end 136, the elongated opening 138 being of a size sufficient to allow movement of a coin therethrough when the first gate 122 is in a position for blocking movement of a coin into the coin receiving section 34 as will be described in more detail hereinafter. The second gate 124 is provided with a greater height than the first gate 122 as shown in the drawing. The differences in the height of the first gate 122 and the second gate 124 is important since when the first gate 122 is positioned to allow movement of the coin through the coin receiving section 34 the second gate 124 will extend into the coin reject section 36 to block movement of the coin into the coin reject section 26 and facilitate in directing the coin into the coin receiving section 34.

The first gate 122 is provided with an upper side 140, an opposed lower side 142, a first side 144, an opposed second side 146, a first end 148 and an opposed second end 150. The first gate 122 is secured to the first side 118 of the body member 116 so that the opposed second end 150 of the first gate 122 abuts the first end 134 of the second gate 124 substantially as shown. Thus, the longitudinal axis of the first gate 122 is substantially perpendicular to the longitudinal axis of the second gate 124.

The gate assembly 14 is operably connected to the solenoid 16, the solenoid including further a pin member 152 having a first end 154 and an opposed second end 156. The first end 154 of the pin member 152 is secured to the body member 116 so that the second end 156 of the pin member 152 extends outwardly away from the opposed second side 120 of the body member 116. The first end 154 of the pin member 152 can be secured to the body member 116 by any suitable means as well known in the art. A plunger member 158 is positioned upon the pin member 152 adjacent the opposed second side 120 of the body member 116. The opposed second end 156 of the pin member 152 is operatively connectable to the body of the solenoid 16, for causing the gate assembly 14 to move in a direction about perpendicular to the coin passageway 18.

The coin chute assembly 10 of the present invention can be fabricated of any suitable material. However, since such assemblies are often used in combination with magnetic elements to detect the presence and authenticity of coins being directed through the coin chute assembly 10, the housing 12 and the gate assembly 14 of the coin chute assembly 10 of the present invention are desirably fabricated of a non-ferrous material, such as plastic. Such materials are well known in the art.

OPERATION

In normal operation, the gate assembly 14 of the coin chute assembly 10 will be positioned within the elongated openings 100 and 106 in the back plate 24 of the housing 12 so that the first gate 122 is positioned within the coin receiving section 34 so as to block passage of a coin therethrough. The second gate 124 will be positioned across the coin reject section 36 of the housing 12 so that the elongated opening 138 of the second gate 124 will openly communicate with the passageway defined in the coin reject section 36 to allow a coin to pass through the elongated opening 138 and thus the coin reject section 36. When a coin is inserted into the coin receiving opening 28 of the housing 12, the coin is fed by gravity into the upper coin path 33 and past the openings 46 and 48 disposed within the back and front plates 24 and 26 of the housing 12. As the coin passes the openings 46 and 48 the coin is interposed between the lamp 50 and the optical sensing element 49. Thus, a portion of the illumination from the lamp 50 is blocked by the coin and the illumination sensing element 49, upon detecting a decrease in the intensity of the illumination from the lamp 50, provides an output signal indicative of the illumination received and thus the presence of the coin in the upper coin path 33. As the coin continues traveling through the upper coin path 33 the coin enters the magnetic field created by the magnet 51. The disruption in the magnetic field caused by the coin passing therethrough provides an output signal, if the coin is a proper coin, (i.e., the coin has the proper magnetic characteristics), such that the output signal, in combination with the output signal from the illumination sensing element 49 activates the solenoid 16 and thus the gate assembly 14. Since the gate assembly 14 is in the operable position in which the first gate 122 is blocking the coin receiving section 34 when the solenoid 16 is in the inactive conditioning, the combined output signals from the illumination sensing element 49 and the magnet 51, (when the combined signals indicate that the coin is a proper coin), activate the solenoid 16 and thus cause the gate assembly 14 to be movably positioned so that the first gate assembly 122 is retracted from the coin receiving section 34 and the second gate assembly 124 is raised a distance sufficient to block the coin reject section 36. Thus, the coin will pass through the coin path 33 into the coin collection box 44 via the coin receiving section 34. However, should the combined signals of the illumination sensing element 49 and the magnet 51 determine that the coin is an improper coin, such as a slug or a penny, the solenoid 16 is not activated and the first gate 122 remains in the extended position substantially intersecting the coin receiving section 34. Thus, the improper coin passes through the elongated opening 138 of the second gate 124 into the coin reject box 40 via the coin reject section 36.

It is readily apparent that the width of the coin path can be varied depending upon the particular coins which are to be varied depending upon the particular coins which are to be allowed to be accepted through the coin chute assembly and based upon the type of unit, whether a telephone, a game, or the like used in conjunction with the coin chute assembly 10. Further, it is to be understood that changes may be made in the construction and arrangements of the parts or the elements of the various embodiments as disclosed herein without departing from the spirit and scope of the invention as defined in the following claims.

What is claimed is:

1. A coin chute assembly comprising:

a housing having a coin receiving opening, a first coin exit opening, a second coin exit opening, and a coin passageway disposed therein and interconnecting the coin receiving opening with the first and second coin exit openings, the coin passageway characterized as having an upper coin path, a coin receiving section and a coin reject section, the upper coin path and the coin receiving section being positionable to permit a coin to fall in a substantially downward direction in a mounted position of the coin chute assembly through the upper coin path and the coin receiving section towards the first coin exit opening, and the upper coin path and the coin reject section being positionable to permit a coin to fall in a substantially downward direction in a mounted position of the coin chute assembly through the upper coin path and the coin reject section towards the second coin exit opening;

a gate assembly having a first portion movably disposable in a portion of the coin receiving section and a second portion movably disposable in a portion of the coin reject section, the gate assembly blocking movement of the coin through the coin receiving section of the coin path in one position and directing the coin into the coin reject section of the coin passageway and the gate assembly being movable to one other position for permitting movement of the coin into and through the coin receiving section of the coin passageway and blocking movement of the coin through the coin reject section of the coin passageway; and wherein the housing comprises a coin receiving end, an opposed second end, a first side and an opposed second side, the first and second sides cooperating to define the coin passageway in the housing, the opposed second side having a first elongated opening extending generally transversely to and intersecting the coin receiving section of the coin passageway, and a second elongated opening extending generally transversely to and intersecting the coin reject section of the coin passageway and wherein the gate assembly is movably disposed in the first and the second elongated openings; and wherein the gate assembly comprises:

a body member having a first side and an opposed second side;

a first gate disposed on the first side of the body member extending from the first side of the body, the first gate being positionable within the first elongated opening in the housing;

a second gate disposed on the first side of the body member and extending from the first side of the body member, the second gate being positionable within the second elongated opening in the housing; and means for moving the gate assembly in a direction about perpendicular to the coin passageway, comprising:

a pin member having a first end and an opposed second end, the first end of the pin member being secured to the body member of the gate assembly and the pin member extending a distance generally perpendicularly from the body member; and a solenoid operatively connected to the pin member generally near the second end of the pin member for moving the pin member and the gate assembly connected thereto in a direction about perpendicular to the coin passageway to move the first gate and the second gate in the respective first and second elongated openings in the housing.

2. The coin chute assembly according to claim 1 wherein the housing is constructed of a non-ferrous material and further includes a pair of aligned openings formed through portions of the housing, each aligned opening extending transversely to and intersecting the upper coin path and each aligned opening extending substantially the entire width of the upper coin path, one of said openings operably receiving an illumination source and the other of said openings receiving an illumination sensing element.

3. The coin chute assembly of claim 2 which further comprises:

magnetic means for detecting the magnetic properties of the coin moving through the upper coin path of the coin passageway, the magnetic means creating a magnetic field within a portion of the upper coin path, the magnetic means operably disposed on the housing a distance from the illumination sensing element such that the operation of one of the illumination sensing element and the magnetic means does not interfere with the operation of the other.

4. The coin chute assembly according to claim 1 wherein the upper coin path comprises:

a first wall having an upper end and an opposed lower end;

a second wall having an upper end and an opposed lower end, the first and second walls of the coin path disposed generally in a parallel relationship extending from the coin receiving end to a position near the opposed second end;

the coin reject section comprises:

a first wall having an upper end and an opposed lower end;

a second wall having an upper end and an opposed lower end, the first and second walls of the coin reject section disposed generally in a parallel relationship and extending in an upwardly direction towards the coin path from the second coin exit, the upper end of the first wall of the coin reject section abutting the lower end of the first wall of the coin path, the upper end of the second wall of the coin reject section terminating below the lower ends of the first and second walls of the coin path at a position substantially intermediate the first and second walls of the coin path, the point of termination of the upper end of the second wall of the coin reject section providing the coin reject section with substantially the same width as the upper coin path; and the coin receiving section comprises:

a first wall having an upper end and an opposed lower end; and a second side wall having an upper end and an opposed lower end, the first and second walls of the coin receiving section disposed generally in a parallel relationship and extending in an upwardly direction towards the coin path, the upper end of the second wall of the coin receiving section abutting the lower end of the second wall of the coin path, the upper end of the first wall of the coin receiving section positioned in uniting alignment with the upper end of the second wall of the coin reject section so that the upper coin path, the coin reject section and the coin receiving section form a coin passageway having a substantially inverted Y-shaped configuration.

5. The coin chute assembly according to claim 1 wherein the first elongated opening in the opposed second side of the housing has a length less than the width of the coin receiving section, and the second elongated opening in the opposed second side of the housing has a length greater than the width of the coin reject section.

6. The coin chute assembly according to claim 5 wherein the first elongated opening has a first end and an opposed second end, the first end of the first elongated opening extending a distance within the opposed second side of the housing beyond the second wall of the coin receiving section in a direction away from the coin receiving section; the second elongated opening has a first end and an opposed second end, the first end of the second elongated opening extending a distance within the opposed second side of the housing beyond the first side wall of the coin reject section in a direction away from the coin reject section so that the second end of the first elongated opening intersects the second elongated opening near its first end to form a substantially L-shaped opening, the second end of the second elongated opening extending a distance within the opposed second side of the housing beyond the second side wall of the coin reject section in a direction away from the coin reject section.

7. The coin chute assembly according to claim 1 wherein the second gate includes an elongated opening disposed therein, the elongated opening being alignable with the coin path of the coin reject section so that when the first gate is in one position for blocking movement of a coin into the coin receiving section the coin can enter the coin reject section through the elongated opening of the second gate.

8. The coin chute assembly according to claim 7 wherein the second gate extends from the body member a distance greater than the first gate so that when the first gate is positioned to allow movement of the coin through the coin receiving section the second gate extends into the coin reject section to block movement of the coin into the coin reject section.

9. The coin chute assembly according to claim 8 wherein the first and second gates of the gate assembly are positioned on the body member so that the longitudinal axis of the first gate is substantially perpendicular to the longitudinal axis of the second gate.

10. The coin chute assembly according to claim 9 wherein the first gate is provided with a first end and an opposed second end, the second gate is provided with a first end and an opposed second end, and wherein the opposed second end of the first gate abuts the first end of the second gate.

11. The coin chute assembly according to claim 1 wherein the means for moving the gate assembly is further defined to include:

a plunger member positioned around a portion of the pin member adjacent the opposed second side of the body member of the gate assembly.

* * * * *